US005133675A

United States Patent [19]

Garthwaite et al.

[11] Patent Number: 5,133,675

[45] Date of Patent: Jul. 28, 1992

[54] FLUSH-MOUNTED TELEPHONE JACK

[75] Inventors: Jay Garthwaite, Fort Morgan; Kenneth Hotchkiss, Golden; Arthur B. Woodward, Lakewood; Brian Lee, Longmont, all of Colo.; Walter C. Lewis, East Northport; Ferdinand E. Orbeta, Briarwood, both of N.Y.

[73] Assignee: Leviton Manufacturing Company, Inc., Little Neck, N.Y.

[21] Appl. No.: 692,109

[22] Filed: Apr. 26, 1991

Related U.S. Application Data

[63] Continuation of Ser. No. 578,038, Aug. 14, 1990, abandoned, which is a continuation of Ser. No. 447,339, Dec. 7, 1989, abandoned, which is a continuation of Ser. No. 310,269, Feb. 13, 1989, abandoned, which is a continuation of Ser. No. 161,531, Feb. 29, 1988, abandoned, which is a continuation of Ser. No. 15,751, Feb. 6, 1987, abandoned.

[51] Int. Cl.[5] ..... H01R 13/60

[52] U.S. Cl. ..... 439/535; 439/459

[58] Field of Search ..... 439/457, 535, 676, 536, 439/459

[56] References Cited

U.S. PATENT DOCUMENTS

| | | | |
|---|---|---|---|
| 3,751,579 | 8/1973 | Nojiri | 439/457 X |
| 4,290,664 | 9/1981 | Davis et al. | 439/676 X |
| 4,407,559 | 10/1983 | Meyer | 439/536 |
| 4,820,192 | 4/1989 | Denkmann et al. | 439/676 X |
| 4,894,024 | 1/1990 | Debortou et al. | 439/535 |

*Primary Examiner*—Eugene F. Desmond

*Attorney, Agent, or Firm*—Paul J. Sutton

[57] ABSTRACT

The present invention teaches a modular telephone jack "system" capable of voice and data applications, which may be relatively flush-mounted within a conventional electrical box or to a surface and which is characterized by the absence of conventional screw terminal technology. A lacing strain relief system facilitates connections in terminal clips which face forward and which are accessible from the front of the system for testing and repair through a snap-off face or cover plate, and facilitates relatively rapid installation and easy access for testing, troubleshooting and wiring. The system may be equipped with combinations of duplex modular jacks of similar outer configurations, such as four, six and eight-conductor versions. The system includes its own "universal" surface-mounting housing of box, where needed.

18 Claims, 9 Drawing Sheets

18
20
22
24
36
32
248
12
30
132
2
164
248
2
256
14
26
20
22
34

106
20
22
98
38
120
118
18
24
102
116
12
14
114
104
108
110
112
28

FIG. 6
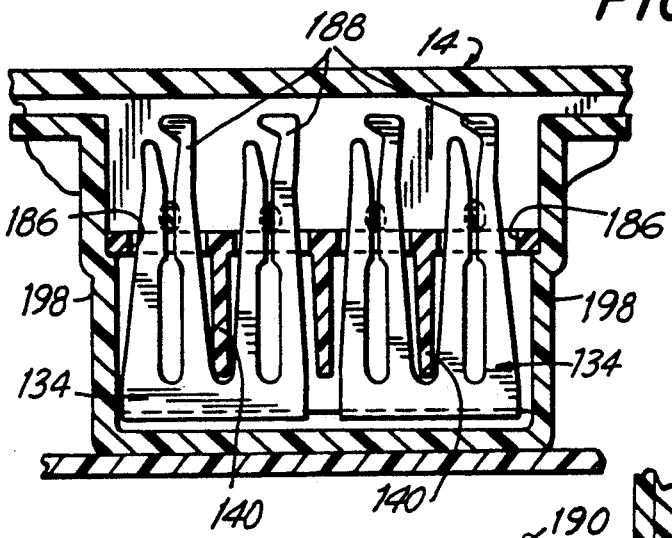
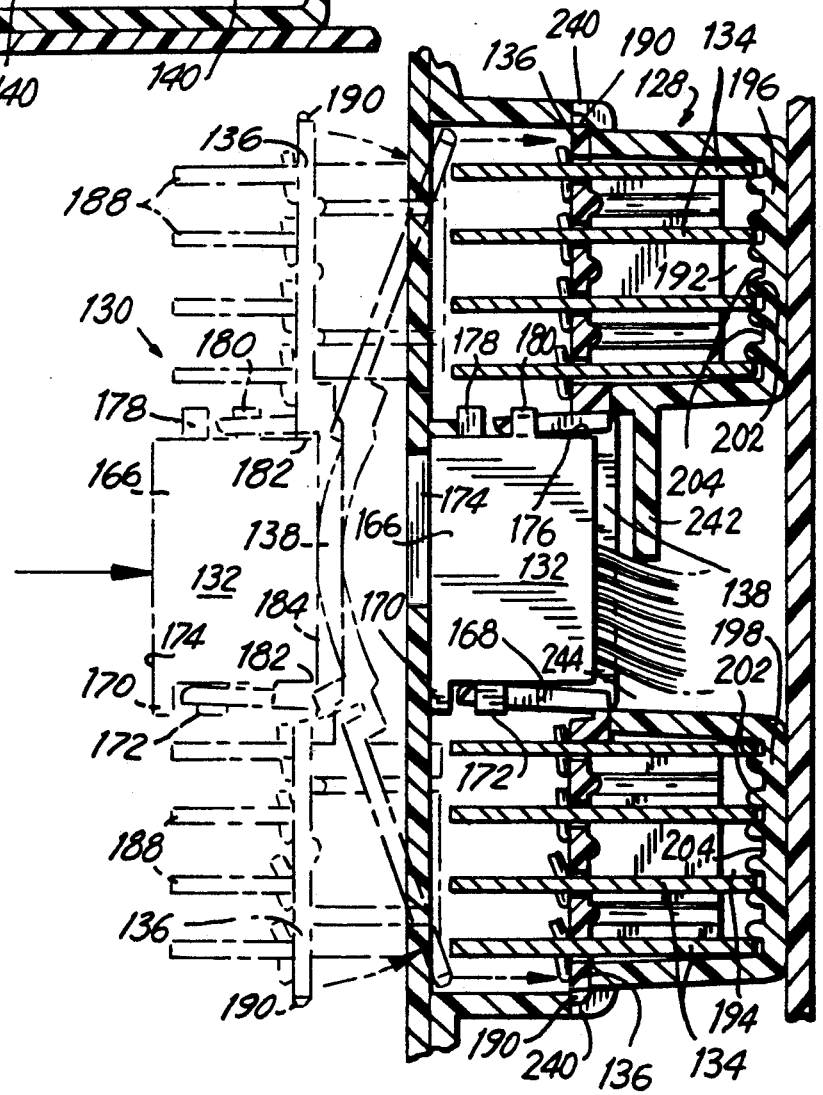
FIG. 7

FIG. 14
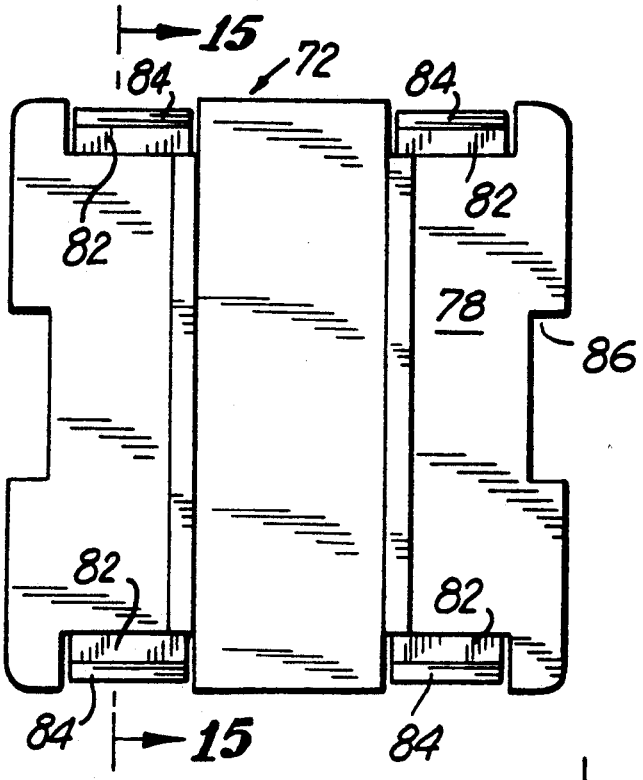
FIG. 15
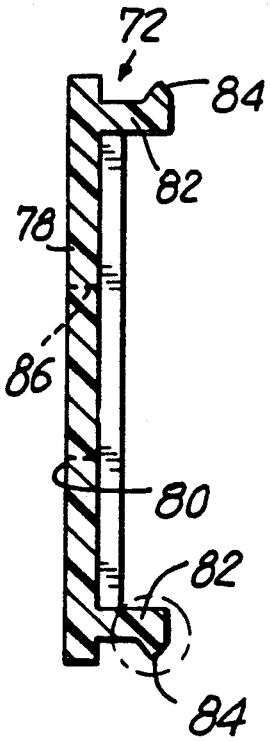
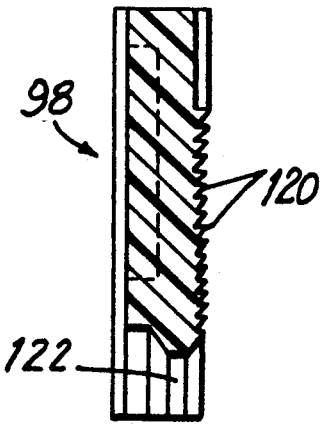
FIG. 17
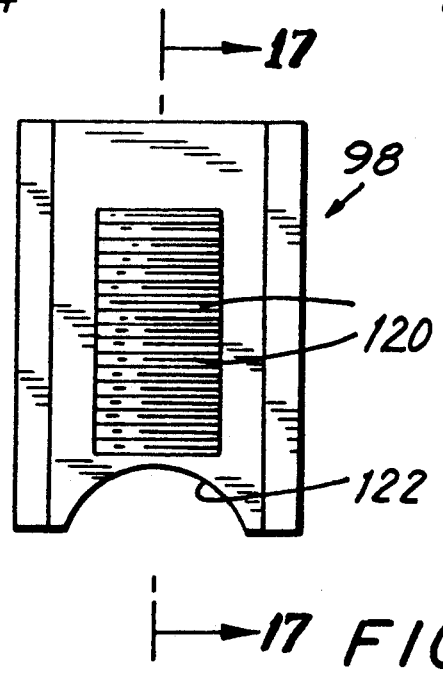
FIG. 16

FLUSH-MOUNTED TELEPHONE JACK

This is a continuation of application Ser. No. 07/578,038, filed Aug. 14, 1990, now abandoned, which is a continuation of Ser. No. 447,339, filed Dec. 7, 1989, now abandoned.

Ser. No. 447,339 is a continuation of application Ser. No. 310,269, filed Feb. 13, 1989 and now abandoned. Ser. No. 310,269 is a continuation of application Ser. No. 161,531, filed Feb. 29, 1988 and now abandoned. Ser. No. 161,531 is a continuation of application Ser. No. 015,751, filed Feb. 6, 1987, and now abandoned.

BACKGROUND OF THE INVENTION

The present invention relates to telephone voice and data carrying devices, and more particularly to a flush-mounted voice and data application jack system.

A need has existed for some time for a system or means by which installers and repair personnel are able to more easily and with less labor handle the installation and repair of telephone and data lines. This need further requires that any such system or means be reliable and efficient in use, and that it not carry with it a severe economic penalty to the user.

Conventional apparatus utilizes technology in which terminates electrical connections in screw-conductor terminations, with these connections at the rear of the wiring devices employed. This type of termination is inherently "uncertain" and often unreliable in the sense that one never is certain how tight the connections have been made, assuming that the installer (or repairperson) has remembered to fully tighten all started connections. With different installers, one realizes different connections in many cases.

Wiring of conventional apparatus most often requires the relatively time-consuming chore of stripping and bending of insulated conductors about each terminal screw after accessing the screws in the rear of the devices and, thereafter, hand-tightening down of the screws on the stripped wires. There is the ever present uncertainty with those connections in which screws are tightened down more firmly that overtightening will result in a severed conductor. It is known that insecure or unreliable terminations or electrical connections result in interference with quality voice communications such as, without limitation, noise, scratchiness and static on the line. In the case of data transmissions, such as between computers, noise on the line resulting from poor connections results in errors and less reliable data transfers, which attack the very heart and goals of reliable data transmissions.

Another drawback of conventional technology resides in the relatively large enclosures required for devices with relatively larger numbers of terminations, such as 16 terminations (conductors). These enclosures themselves include covers which require screw-type fasteners for access to the connections. With conventional technology, a repairperson must access the rear screw terminations for employing test equipment, this in many instances resulting in the disturbance of existing terminations due to what has conventionally required the removal and turning of wiring components.

As for the conventional technology in which insulation displacement clips and wiring tools are utilized, none are free from one or more of the aforesaid disadvantages or limitations, and none of the known existing devices exhibit the combination of elements taught by the present invention, whether taken singly or in any combination with one another.

It is an object of the present invention to provide a combination of elements in which a telephone and data modular jack outlet eliminates screw-type conductor connections.

SUMMARY OF THE INVENTION

It is another object of the present invention to provide such a combination which is mountable within a conventional size in-wall electrical outlet box.

Yet another object is to provide such a combination which drastically reduces the labor, skill and time required to install and/or repair same.

A further object of this invention is to provide such a combination, wherein reliable and efficient terminal clip technology is employed.

Another object is to provide such a system, wherein a variety of jack configurations (number of conductors, etc.) are enveloped within a system jack outer configuration, enabling one to inventory and snap-in those jacks desired.

Still another object of the present invention is to provide a combination as above, wherein access to terminations is at the face or front of the devices, as opposed to in the rear, and wherein conventional removal and turning of same is not required.

Another object is to provide such a combination, wherein a unique "lacing" of conductors yields a strain relief benefit which, in addition, provides the user with spare wire for possible later repairs that may require shortening of the wires and reconnections.

Still a further object is to provide the foregoing combination in a structure that is unique, eliminates the need for screw-type assembly, is self-aligning, and utilizes a snap-together-apart system.

Yet other objects include the elimination of the aforesaid disadvantages and limitations of conventional or prior art devices, systems and methods.

BRIEF DESCRIPTION OF THE DRAWINGS

Further objects of the present invention and its features will suggest themselves to those skilled in the art upon a reading of the present specifications, together with the drawings annexed hereto wherein, throughout the several views, similar reference characters denote similar elements, and wherein:

FIG. 6 is a sectional view taken along the line 6—6 of FIG. 2;

FIG. 7 is a sectional view taken along the line 7—7 of FIG. 2;

FIG. 14 is a plan view of an insert tape pad according to the present invention;

FIG. 15 is a sectional view taken along line 15—15 of FIG. 14;

FIG. 16 is a front view of a strain relief insert according to the present invention; and FIG. 17 is a sectional view taken along line 17—17 of FIG. 16

DETAILED DESCRIPTION OF THE INVENTION

Figure 1:
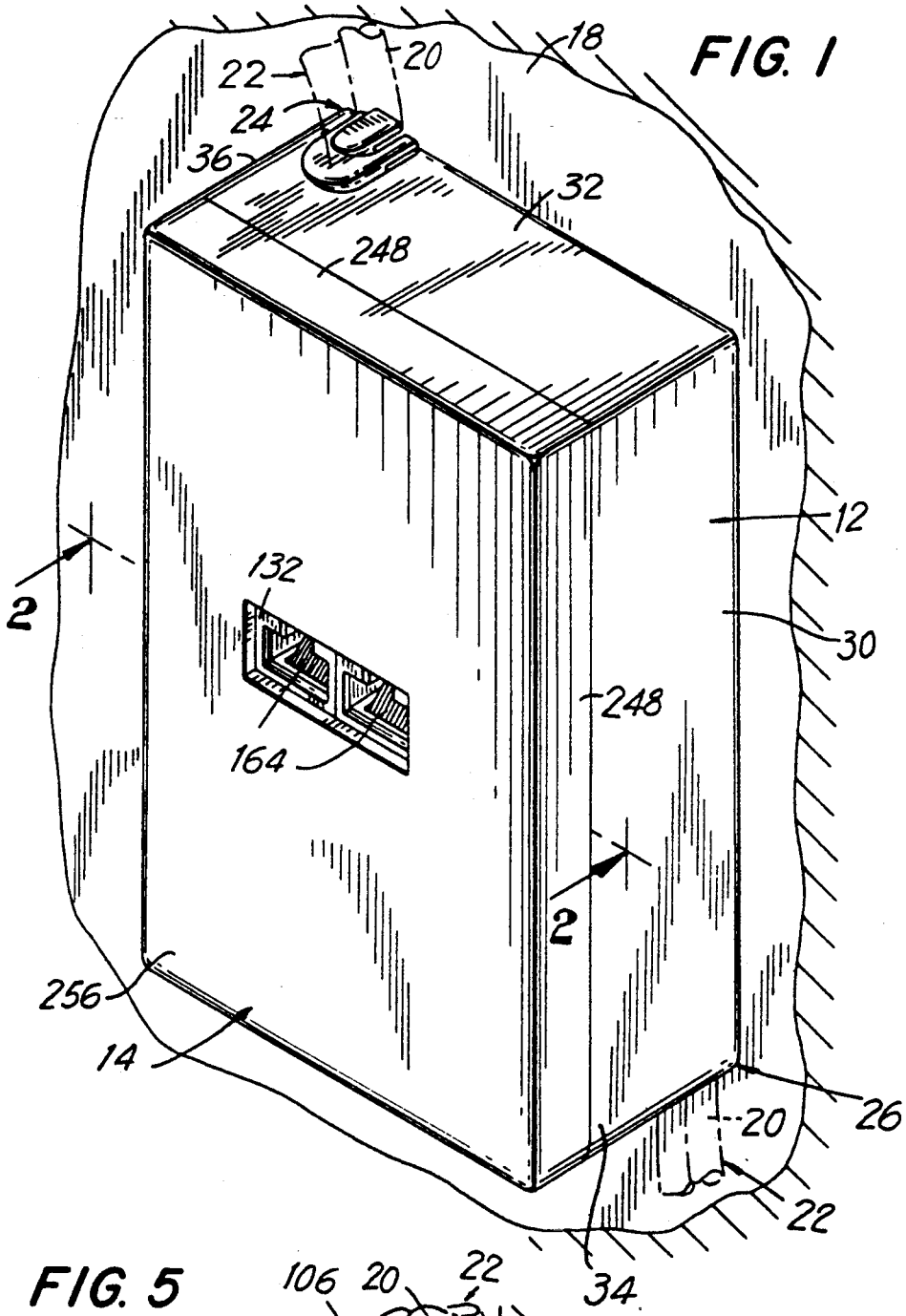
FIG. 1 is an upper right perspective view of a jack with its face plate in place and mounted to a wall surface.

Referring now in more detail to the drawings, FIG. 1 illustrates in a perspective-type view a flush-mounted telephone jack system 10 according to the present invention, mounted by means of screws to a wall surface or the like. Throughout the present specification and possibly the claims hereof, the term "system" may be used to emphasize the fact that the present invention teaches not only a novel wiring device capable of use with voice and data communications, but also in its broadest context a "system" including cooperating and mating components, some of which are not absolutely essential for the invention to operate according to its intended functions.

By way of example only, and without limitation, a universal housing 12 used with its front cover plate 14 is illustrated in FIG. 1 neatly and efficiently housing and maintaining other components of system 10 which will be described in detail below. According to the present invention, while universal housing 12 is available to the user, the user may at his or her option prefer to utilize an existing or purchased standard outlet box of the type used to house electrical switches and outlets, for example. And yet it is believed that once one experiences the use of this universal housing 12, one will prefer to use same thereafter. In this regard, one of the considerations will be whether the user wishes the system 10 to be flush, as opposed to surface, mounted. In FIG. 1 the system is secured by means of screws 16 to surface 18.

While system 10 according to the present invention may be used at a "terminal" end of a wiring configuration, the system has been illustrated in FIG. 1 as being "in line", with the outer insulating jacket 20 of a multiple conductor cable 22 entering housing 12 at diagonally opposite ends 24 and 26 thereof. A unique strain relief arrangement which is described below firmly holds cables 22 in place.

Universal housing 12 serves as a system back or rear cover and is formed by injection molding from a thermoplastic material with a rear or outer bottom side 28 which abuts wall 18, as illustrated in FIG. 1. Side walls 30 of housing 12 meet top and bottom walls 32 and 34, respectively, at smooth and rounded edges 36. Top, bottom and side walls 32, 34 and 30 terminate at their respective forwardmost extremities at generally planar forward-facing surfaces 38, which extend around the periphery of the opening 40 of housing 12.

As best seen in FIGS. 2, 3, 4 and 12, housing 12 is formed with upstanding mounting posts 42 which are integral with housing rear side 28. For molding, weight and other considerations that will be appreciated, mounting posts 42 are generally hollow and include tapered base portions 44 which extend upwardly to platforms 46 of arcuate shape and of sufficient surface area to withstand predetermined bearing forces. Mounting posts 42 terminate at their uppermost extremities in split, spaced-apart fingers 48 which are flexible enough to be biased toward one another and thereafter to spring back to their unstressed positions. Fingers 48 are preferably but not necessarily formed with oppositely directed and curved flanges 50 which provide a generally circular split profile.

Figure 12:
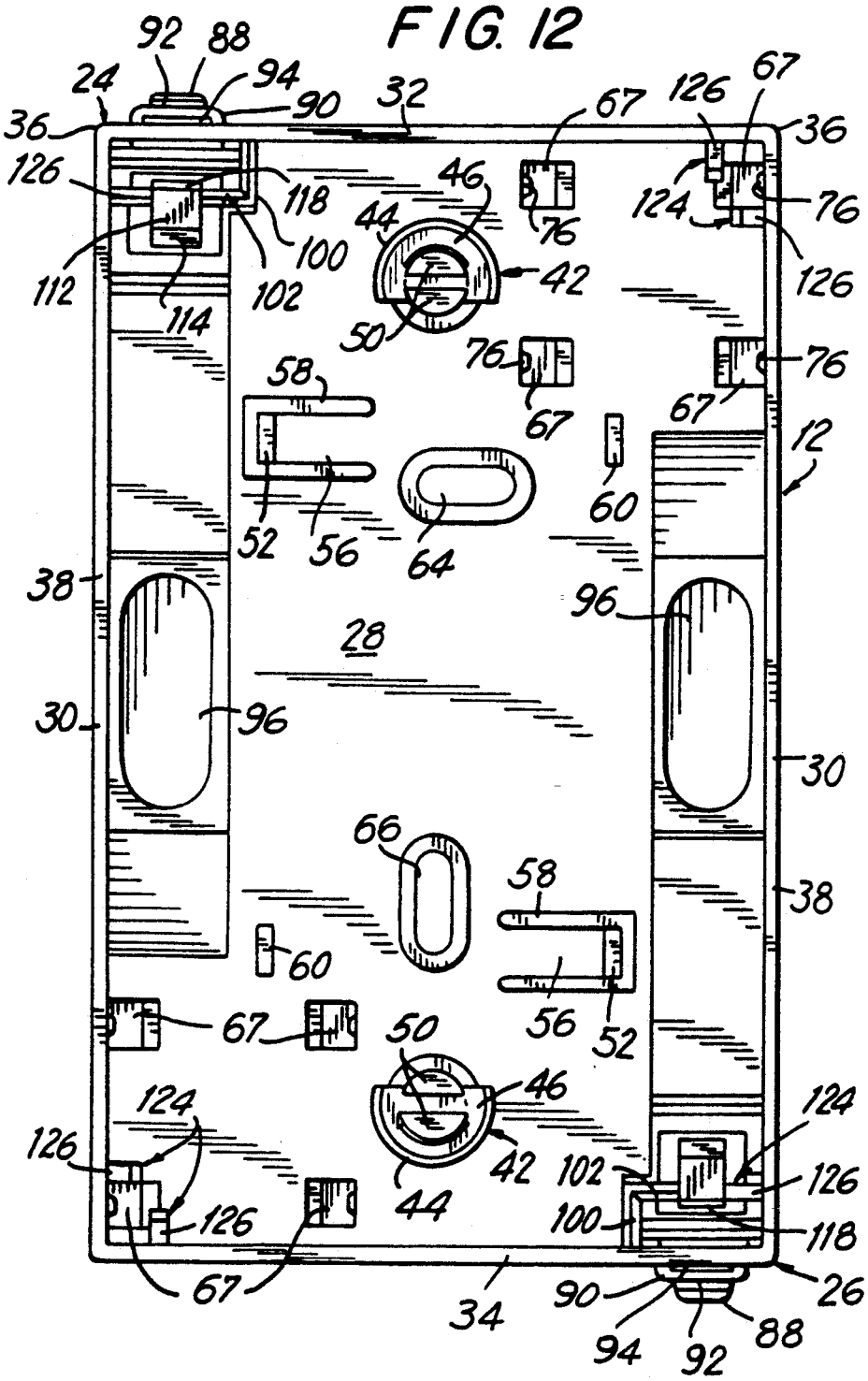
FIG. 12 is a top plan view of a universal housing according to the present invention, looking at its inner bottom surfaces.
Figure 13:
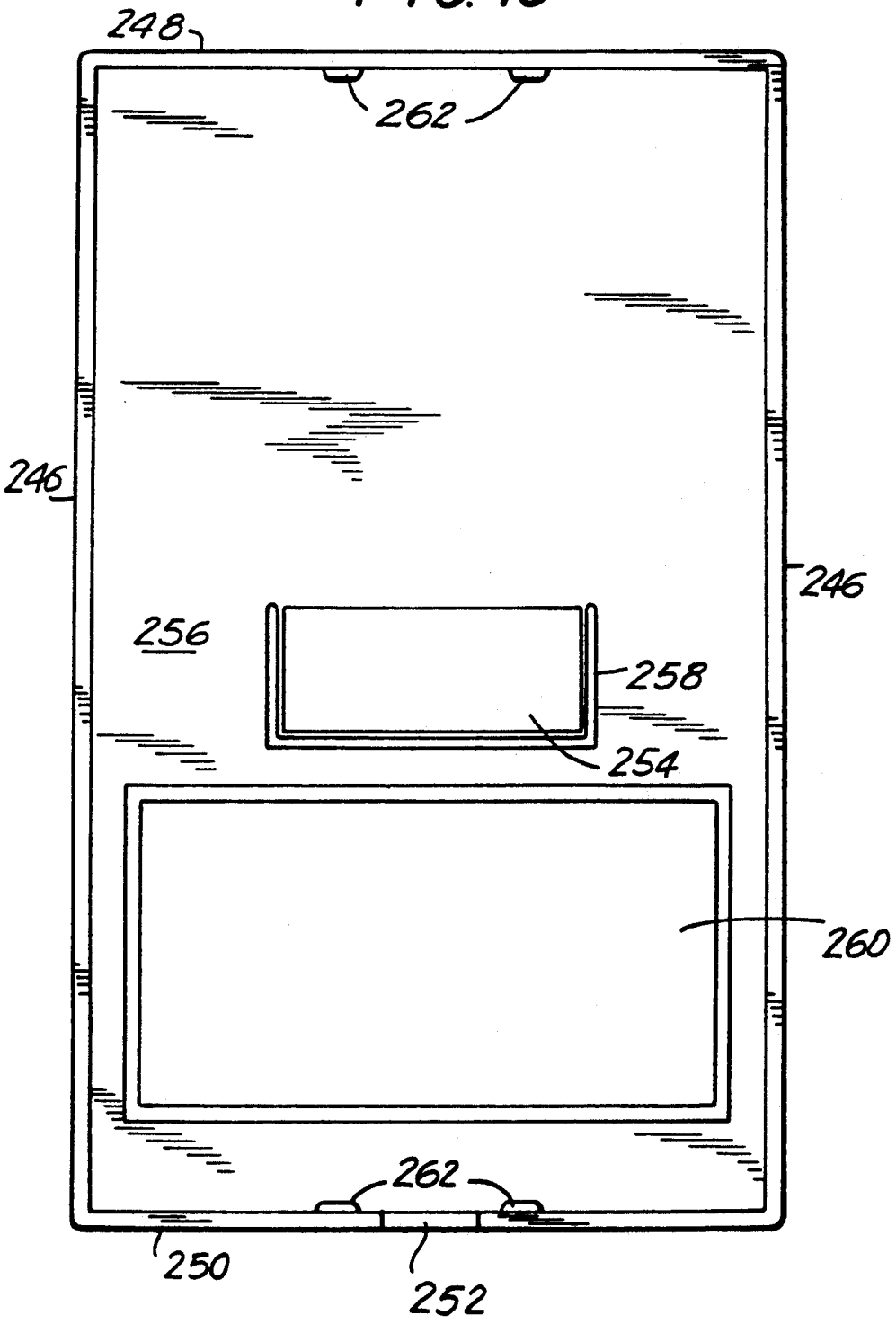
FIG. 13 is a bottom plan view of a front cover plate according to the present invention, looking at its inner surfaces.

Universal housing 12 is further formed with a pair of movable leaf spring supported protrusions 52 which extend upwardly out of the general plane of the surfaces 54 of rear wall 28 (FIG. 12). These flanges are actually right-angled extensions of resilient tabs 56 resulting from U-shaped slots 58 formed through wall 28. Protrusions 52, together with fixed or stationary protrusions 60 (see also FIG. 3), provide means for enabling assembly and alignment of a jack subassembly 62 (FIG. 2), described in more detail below.

Elongated counterbored slots 64 and 66 (FIGS. 4 and 12) are formed through rear wall 28 of universal housing 12, the axes of these slots being normal with respect to one another. It is slots 64 and 66 which enable screws 16 to hold housing 12 to a mounting surface, the perpendicular axes facilitating alignment and positioning by the installer.

Figure 3:
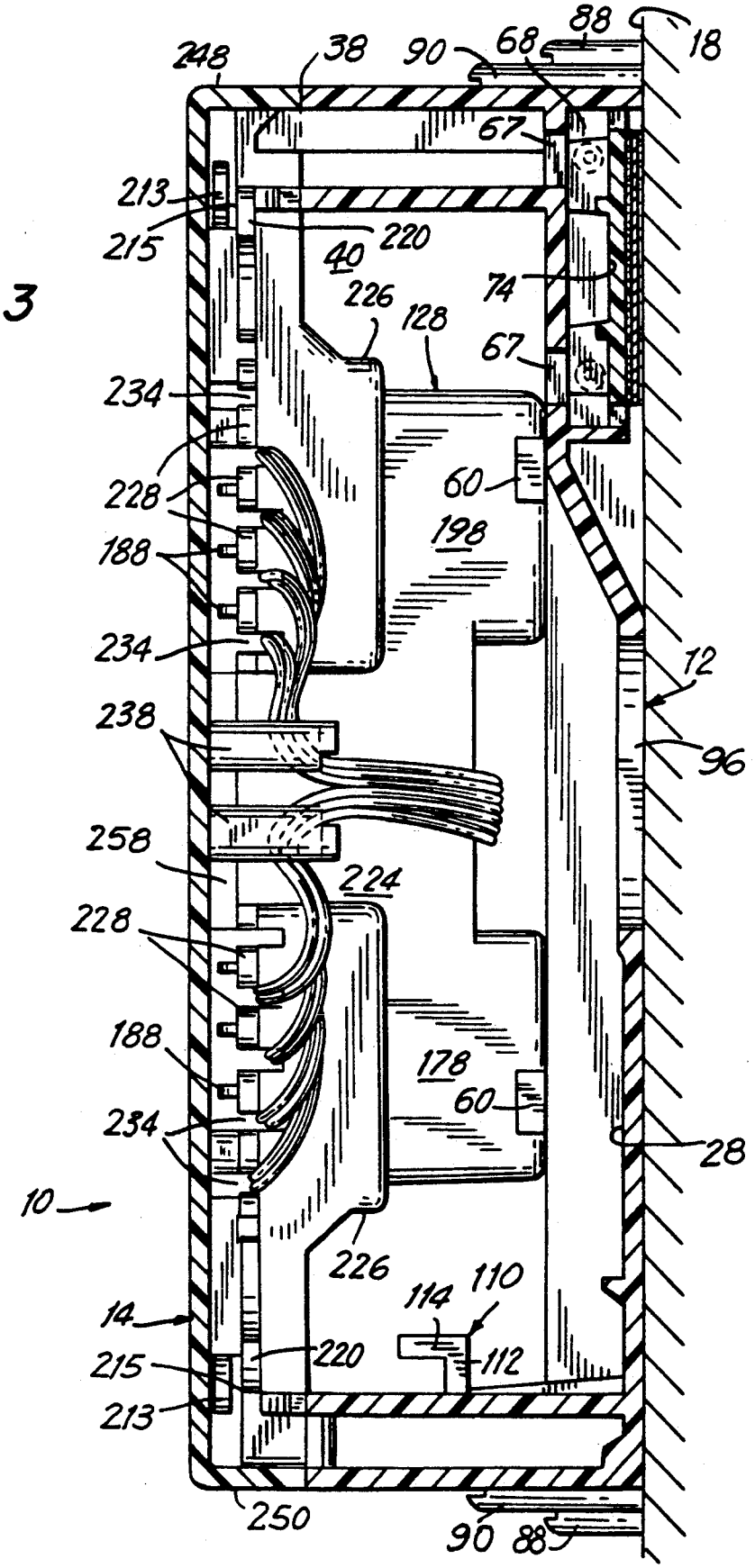
FIG. 3 is a sectional view taken along the line 3—3 of FIG. 2.
Figure 11:
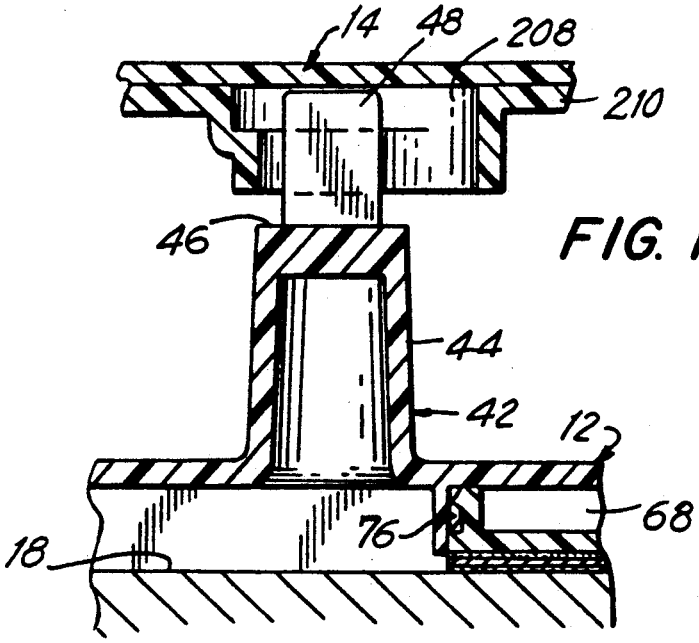
FIG. 11 is a sectional view taken along the line 11—11 of FIG. 2.

Through holes 67 formed in wall 28 permit access via a tool (not shown) to a pair of mounting compartments 68 FIG. 3), each of which is able to hold and accommodate either of a pair of magnets (not shown) or a pair of double-sided insert tape pad supports 72. Compartments 68 are relatively square shaped and are formed with a plurality of shoulders 74 (FIG. 3) and teats 76 (FIGS. 11 and 12) which, cooperatively, served to position/hold the magnets or tape pads 72 in place within compartments 68. In the case of the magnets, these subassemblies basically consist of a magnetic material held within a U-shaped metallic enclosure.

The insert tape pads 72 comprise injection molded thermoplastic wafers 78 formed with a relatively flat planar surface 80 to which double-sided tape is preferably secured, this wafer being further formed with depending flanges 82 themselves formed with outwardly extending ridges 84. The periphery of wafer 82 is interrupted by at least one slot 86 which is large enough to accommodate the entry of a screwdriver or other tool (not shown) used to remove the insert tape pad from the mounting compartment 68 where necessary. Insert tape pads 72 are designed to be snapped into compartments 68 without the need for tools, this being facilitated by the positioning of the teats 76 so as to provide desired interference with ridges 84. Shoulders 74, in turn, provide surfaces which limit movement of the pads 72 and hold same relatively parallel with respect to wall 28 so as to provide a secure mounting surface for the double-sided tape. These same shoulders serve to laterally limit the movement of the magnets 70 when this alternative mounting method is employed.

Figure 2:
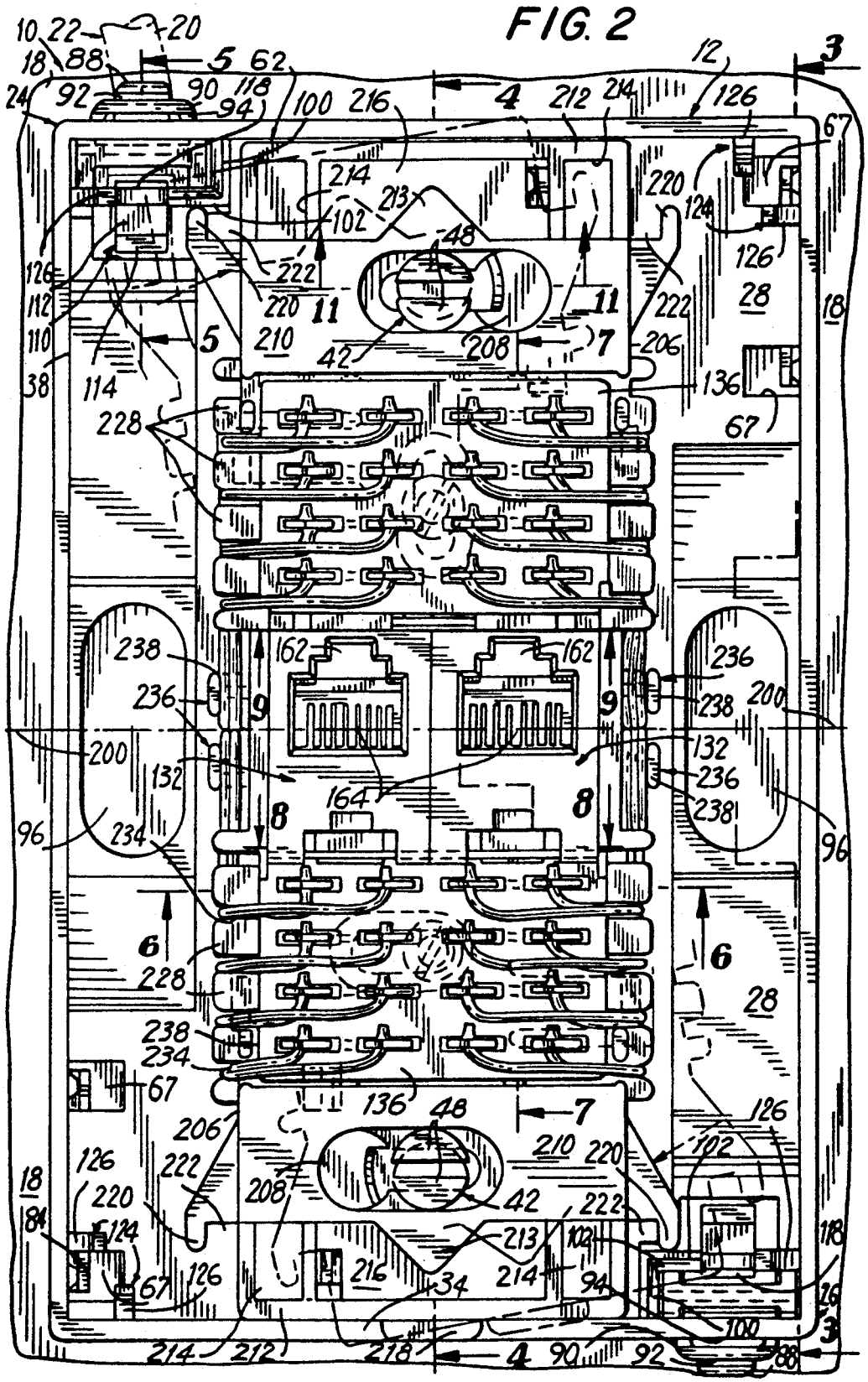
FIG. 2 is a sectional view taken along the line 2—2 of FIG. 1.

The uniqueness of universal housing 12 will be yet further appreciated when one looks at the means by which a variety of different sizes of conductor cables may be used in conjunction with housing 12. At diagonally opposite ends 24 and 26, housing 12 is formed with smaller and larger breakaway tabs 88 and 90, respectively (FIGS. 2 and 12). Breakaway tabs 88 and 90 are formed in piggyback arrangement with the smaller tab 88 formed at the outside such that it is accessible without disturbing tab 90. Each of these tabs is separated from its respective support by gaps 92 and 94 into which a fingernail or tool may be inserted to break off the desired one or both tabs, depending upon the size of cable being used. The outside diameter of the jacket of the conductors being used will determine whether one or both of these tabs must be removed. It should also be emphasized here that concealed wires may enter housing 12 via alternate access openings 96 formed through laterally opposite sides of wall 28 substantially mid-length.

Figure 5:
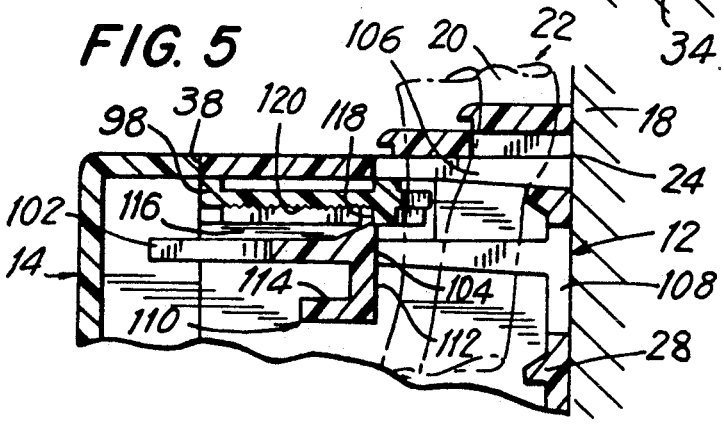
FIG. 5 is a sectional view taken along the line 5—5 of FIG. 2.

The present invention includes strain relief means for holding the jacket 20 of multiconductor cable firmly, thereby ensuring solid, undisturbed connections. This is facilitated via the use of a strain relief insert 98 (FIGS. 16 and 17) which may be removably inserted into housing 12. The housing is formed with interior walls 100 and 102 at the diagonally opposite ends 24 and 26 defined above. Walls 102 are each formed with an opening 104 (FIG. 5) which communicates with and is substantially aligned with the openings 106 in top and bottom walls 32 and 34 through which the jacket 20 of the cable extends. Yet another pair of openings 108 formed through rear wall 28 are located directly beneath walls 102.

A strain relief release tab 110 (FIG. 5) is integrally molded with and extends inwardly from each of walls 102. Tabs 110 are formed by means of perpendicular members 112 and 114 which join at right angles. Walls 100 and 102 define a strain relief cavity 116 into which a projection 118 integral with release tab 110 extends. It is into this same cavity 116 that strain relief insert 98 is placed.

Strain relief insert 98 is formed of plastic and includes a plurality of tapered ratchet teeth or ledges 120. Insert 98 is further formed with an arcuate notch 122 of a predetermined radius designed to accommodate a number of conductor jacket diameters. When a conductor cable and its jacket 20 are placed in and through openings 106 in top and bottom walls 32 and 34, strain relief insert 98 is placed into cavity 116 with its notch 122 facing jacket 20. By pushing strain relief insert 98 toward and into contact with jacket 20, projection 118 cooperates with ratchet teeth or ledges 120 so as to enable one-way movement only in the direction of the cable, such that predetermined or desired holding forces of the insert 98 against jacket 20 may be achieved and maintained. Release of these ratchet holding forces and movement of strain relief insert 98 away from jacket 20 is facilitated by means of the user or installer inserting a tool such as a screwdriver through opening 108 into contact with member 112 of release tab 110, and further movement or pushing of the tool against member 112 will result in a movement of the release tab and its integral projection 118 out of the path of teeth or ledges 120, such that the insert 98 is unrestrained and free to be moved or removed from cavity 116.

A number of bevel-shaped projections 124 (FIGS. 2 and 12) are integrally formed with the top, bottom and side walls of housing 12 such that they extend out from the plane of forward facing surfaces 38. Projections 124 include sloped bearing surfaces 126 which serve to align and position front cover plate 14 when the latter is snapped into position onto universal housing 12 and its "contents".

Turning now to these "contents", what has previously been referred to as a "jack subassembly" 62 comprises two primary structural elements which are assembled, namely, a rear cover 128 and a clip retainer insert 130 (See FIG. 7 for separation of these elements). Two, four, six or eight-conductor modular telephone jacks 132 are thereafter snapped into place and wired to 66-clip type conductor terminals 134. For purposes of illustration only, and without limitation, the present invention will in this specification be described illustrating duplex modular jacks. The present invention contemplates among other configurations two four-conductor jacks, two six-conductor jacks, 1 six-conductor combined with an eight-conductor jack, and two eight-conductor jacks.

Figure 4:
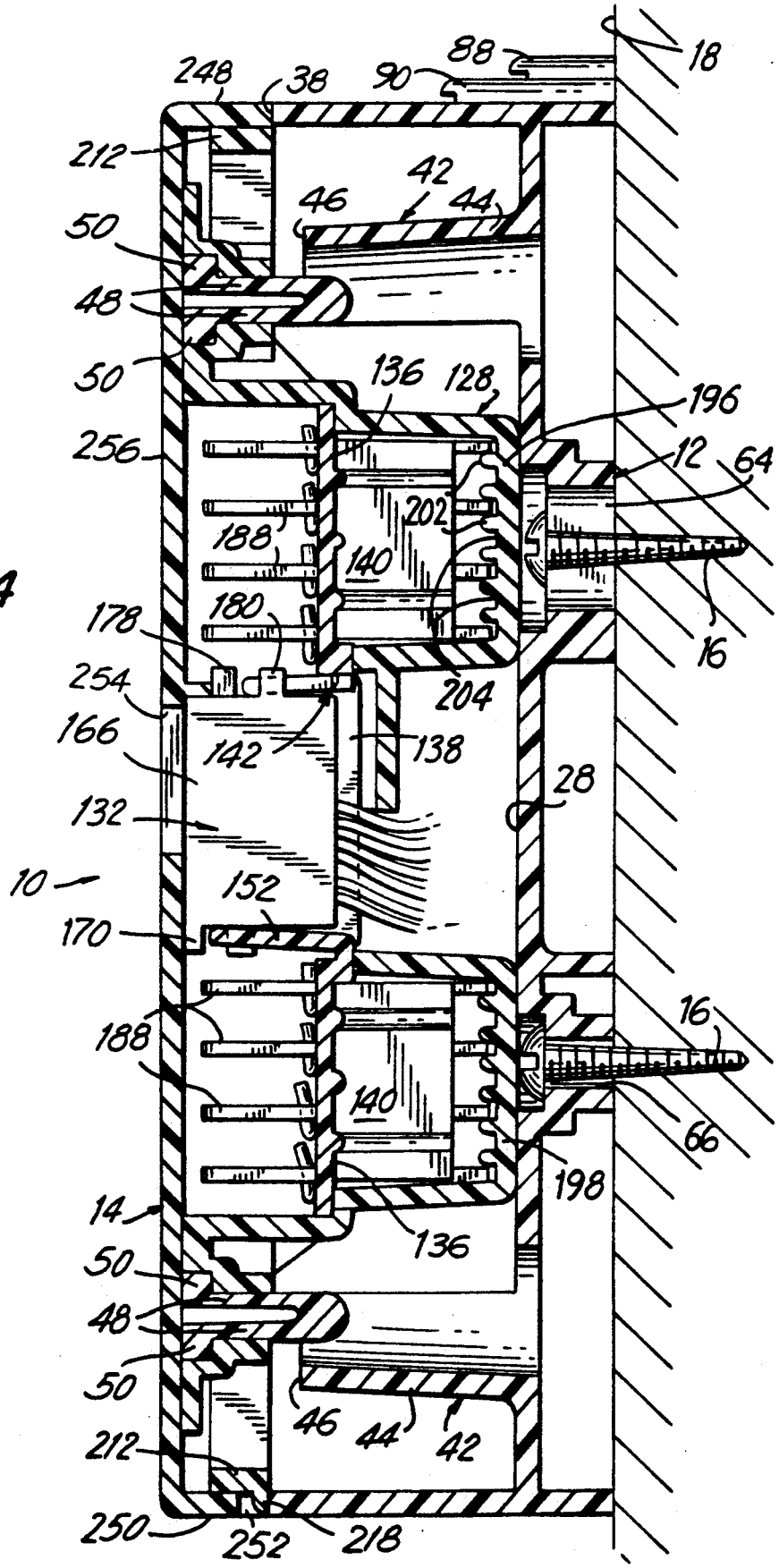
FIG. 4 is a sectional view taken along the line 4—4 of FIG. 2.
Figure 9:
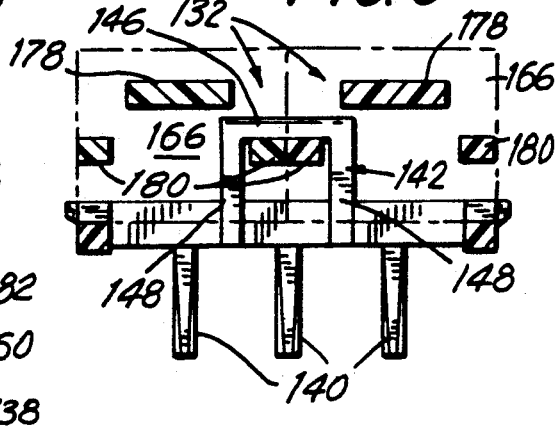
FIG. 9 is a sectional view taken along the line 9—9 of FIG. 2.

Clip retainer insert 130 is fabricated by injection molding from a thermoplastic material. A pair of generally planar members 136 are integrally joined by means of connecting arms 138 (FIG. 4). Positioning fin members 140 extend downwardly beneath planar members 136 and are substantially equally spaced from one another. Fin members extend in a generally longitudinal direction substantially parallel to arms 138. A single loop member 142 (FIG. 9) extends upwardly from the plane of members 136 and is formed with a relatively large and substantially central opening 144 therethrough. Opening 144 is defined by a central bridge member 146 and parallel supports 148 integrally located on opposite sides thereof. Bridge member 146, in turn, is formed with internal bearing surfaces 150 which serve a function described below.

Figure 8:
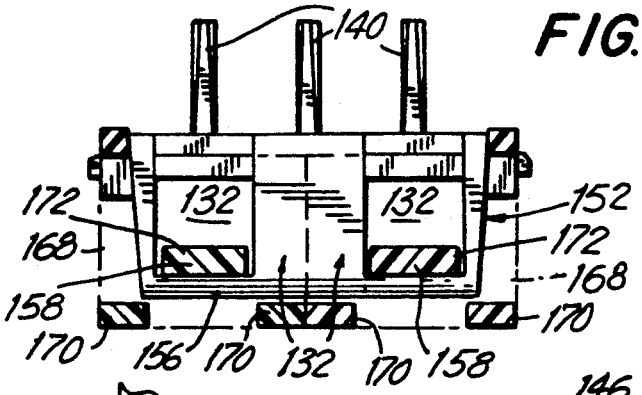
FIG. 8 is a sectional view taken along the line 8—8 of FIG. 2, illustrated in apparent upside down orientation for comparison with FIG. 10.
Figure 10:
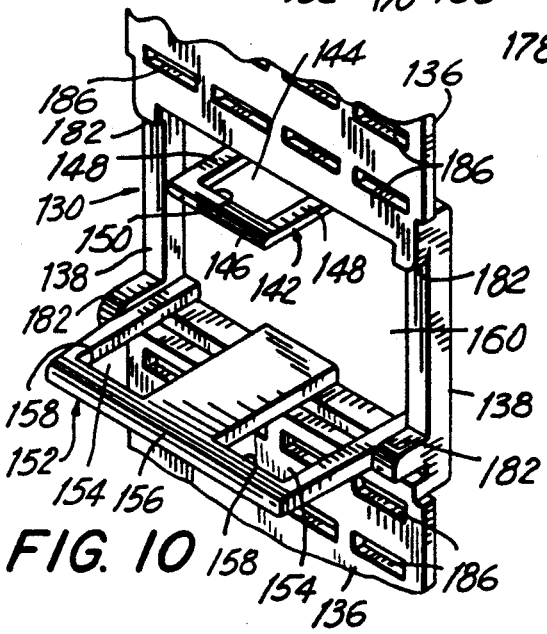
FIG. 10 is an upper right fragmentary perspective view of a portion of a clip retainer mount.

A second double loop member 152 (FIGS. 8 and 10) likewise extends upwardly from the plane of members 136 and is formed with a pair of spaced-apart openings 154 therethrough, each of which is partially defined by bridge members 156 formed with internal bearing surfaces 158. While the term "members" is used herein to assist the reader in understanding those portions of the components of the present invention being described, one of the beauties of this invention resides in the use of injection molded and integrally formed structural components which snap together without the need for tools, or the like. Accordingly, the term "member" does not denote separate elements which must be assembled in labor intensive manners.

Single and double loop members 142 and 152, respectively, face one another at opposite longitudinal sides of a substantially central recess 160 defined by arms 138 and planar members 136, and each extends upwardly at an angle with respect to the plane of said arms 138 equal to approximately eighty seven (87) degrees. Thus, the upper extremities of loop members 142 and 152 are closer to one another than their respective bases, and the fact of their resilience permits cooperative holding of pairs of telephone jacks 132 therebetween (described below).

Each of the jacks 132 includes a housing 166 within which a modular opening 162 and contacts 164 are disposed. Housing 166 is formed at one longitudinal end 168 with spaced upper bosses 170 at transversely opposite upper sides of jack end 168, and with a generally upper central ledge 172 extending parallel with the jack's upper face 174 at an elevation below the bosses 170. Longitudinally opposite jack end surfaces 176 are formed with a mirror image central ledge 178 and with bosses 180 located below ledge 178 rather than above the ledge as in the case of bosses 170.

Facing shoulders 182 together with arms 138 define positioning slots 184 whose widths correspond to the length of jack housing 166. Thus, jacks 132 may be snapped into place and held by clip retainer insert 130 without the use of tools by first positioning one of bosses 180 in opening 144 of single loop member 142 beneath bearing surfaces 150, and with jack housing 166 situated such that one side thereof lies within a positioning slot 184 between facing shoulders 182. Thereafter, double loop member 152 may be moved away from single loop member 142 until ledge 172 drops past and below bridge member 156 and finally into an opening 154 in a snap-in type manner. In this position, the jack 132 is held securely in place and cannot move laterally due to interference between the side edges of ledge 172 and the inner side surfaces defining opening 154. Downward movement of jack 132 is prevented by the presence of bosses 170 overlying double bridge member 156 and ledge 178 overlying a portion of bridge member 146, while a side portion of the jack housing 166 sits atop an arm 138. The second jack is installed in the same manner such that jacks 132 are finally situated in a side-by-side duplex arrangement. Jacks 132 may be wired before or after insertion into clip retainer insert since relatively generous access to the jack contact terminals is provided with the present invention.

Clip retainer insert 130 is further formed with a plurality of spaced rows of clip slots 186 (FIG. 10) which are able to accommodate the spring legs 188 of terminals 134. With each terminal 134 including two spaced pairs of spring legs 188, each terminal 134 is assembled to the insert 130 by inserting the spring legs 188 upwardly through clip slots 186 such that a fin member 140 is situated between the pair of spring legs (FIG. 6), with the downward extremity of the fin member 140 limiting upward movement of the terminal, thereby jigging or precisely locating the upwardly extending ends of spring legs 188 with respect to the clip retainer insert 130. With the terminals 134 installed or assembled, and the jacks in place (they may be installed afterward), the clip retainer insert is ready to be assembled into the rear cover, described below. Snap-in assembly and retention of clip retainer insert 130 into rear cover 128 is enabled by provision of two pairs of locating tabs 190 extending longitudinally outwardly from spaced positions on planar members 136 of the clip retainer insert 130. These tabs 190 matingly cooperate with matching openings in the rear cover, and assembly of the clip retainer insert into this rear cover is accomplished by flexing or bowing of the planar members 136 and arms 138 so as to reduce the overall length of insert 130 so as to create an interference fit within a cavity to be described.

Rear cover 128, like other parts described above, is formed by injection molding techniques from a thermoplastic material. A pair of spaced terminal pockets 192 and 194 are formed by bottom and side walls 196 and 198. Pockets 192 and 194 are substantially equidistant from a transverse plane 200 of near but not exact symmetry. Substantially equally spaced upstanding ribs 202 (FIGS. 4 and 7) are integrally formed with and extend from inner surfaces of bottom walls 196, with their uppermost extremities being rounded to permit and encourage entry of the bases of terminals 134 into the spaces 204 therebetween, such that movement of these bases is inhibited or prevented.

Terminal pockets 192 and 194 are located beneath the plane of integral strap extensions which are formed with bayonet-action partially counterbored through slots 208 utilized for fastener mounting. Slots 208 are formed through generally rectangular strap portions 210 from which outer rectangular frames 212 formed with smaller side openings 214 and a larger central opening 216 through each. At one end, frame 212 is further formed with a locking tab 218 (FIG. 2) which extends longitudinally outwardly from the main frame body. Frames 212 serve to extend the length of rear cover 128 to its desired length, as well as providing additional structural strength and handling means. A pair of transversely outwardly extending lacing arms 220 protrude from each strap portion 210, these arms providing pathways 222 through which conductors may be laced, as will be later described.

Lateral walls 224 (FIG. 3) of rear cover 128 integrally join terminal pocket side walls 198 with end walls 226. At their lateral upper extremities, terminal pocket side walls 198 are formed with a plurality of relatively equally spaced lacing tabs 228, each of which is formed with vertical and right-angled horizontal and vertical portions, respectively. The resulting shape in each case approximates a "hook", around which there are gaps 234 through which conductors may be threaded or laced.

A pair of relatively larger spaced lacing hooks 236 extend approximately midlength from each lateral wall 224, these hooks 236 being formed with vertical struts 238 which are spaced a sufficient distance from walls 224 to provide a pathway for a predetermined number of conductors between each strut and its proximate wall 224. End walls 226 are formed with spaced relatively small locating apertures 240 (FIG. 7), each of which is able accommodate the partial or full entry of a locating tab 190. The area between terminal pockets 192 and 194 is half covered by a longitudinally extending shelf 242 which, apart from adding to the structural integrity of the rear cover, adds shielding protection to the area beneath jacks 132 in their assembled positions. The void 244 between shelf 242 and its opposing terminal pocket permits access to the jack terminals with a wiring tool, as well as an inspection window for an installer, user or repairperson.

The reader's attention is now directed to what has been referred to above as front cover plate 14. Cover plate 14 is generally rectangular in shape — corresponding to the shape of universal housing 12, extending between sides 246 and top and bottom ends 248 and 250, these sides and ends comprising a peripheral flange. Bottom end 250 is formed with a central notch 252 (FIG. 4) sized to accommodate therein the locking tab 218 described in connection with rear cover 128. A central opening 254 through face 256 of plate 14 is surrounded on three sides with an internal U-shaped wall or rib 258. Depressions and pads of desired shape and location are provided on inner and outer surfaces of cover plate 14, to permit the user or installer to add indicia, such as pair and cable information, identifying (extension) numbers, etc. A pair of integral spaced locking/positioning tabs extend inwardly from top end 248.

In use, it is contemplated that jacks 132 will in all but rare cases be assembled and wired in production, as opposed to in the field. Thus, at the assembly location (such as at the manufacturing facility), terminals 134 are assembled to clip retainer insert 130 by inserting spring legs 188 into and through adjacent clip slots 186 until stopped by a fin member 140. With terminals 134 in place, insert 130 is bowed (illustrated in phantom outline in FIG. 7) such that its midsection is at a higher elevation than its longitudinal ends, thereby decreasing its overall length, and the bowed insert is lowered into rear cover 128 such that the two pairs of locating tabs 190 matingly engage locating apertures 240 which, upon release of the bowed insert 130 and its resilient return to its unstressed configuration, securely hold the insert and its associated terminals 134 in place.

At this point jacks 132, whose terminals communicate with their respective modular contacts, are or have been wired such that the conductors have one free end at a predetermined length of wire and the opposite end electrically connected to a jack terminal. Jacks 132 with their associated trailing wires are assembled to the clip retainer insert 130 now itself snapped into rear cover 128. This is accomplished by first positioning one of the bosses 180 within opening 144 of loop member 142 beneath bearing surfaces 150 and thereafter, with jack housing 166 disposed such that one side thereof lies within a positioning slot 184 between facing shoulders 182, double loop member 152 is moved in a direction away from single loop member 142 until jack ledge 172 drops past and below insert bridge member 156 and finally into opening 154. The resilient double loop member 152 is then released such that it returns toward its unstressed position, capturing and holding the jack 132 in a stable and secure location in which it is able to releasably receive one or more modular plugs. The second of the duplex jacks is snapped into place without tools in much the same manner.

At this point in the assembly sequence, the trailing jack wires or conductors are "laced" from beneath the rear cover, with wires coming from the jack terminals extending through void 244 and thereafter to one of the rear cover sides and up against a lateral wall 224 to the space between adjacent lacing hooks 236. The wire is laced through this space and over one of the hooks 236 to and around a lacing arm 220 and thereafter to and through a gap 234 between adjoining lacing tabs 228 and then to and into hooked engagement with a desired or preselected terminal 134 in an outside row of terminals. In addition to the mentioned lacing aids provided by the present invention, triangular tabs 213 located toward each end of the device lie relatively above the plane of frames 212 with a gap 215 permitting the passing or lacing of one or more conductor wires from either side, between the tabs 213 and frames 212 and through gaps 215, to the other side of the device, thereby "keeping" these wires from the interface between snap-on front cover plate 14 and its associated universal housing 12.

A tool (not comprising the present invention) is used to "punch down" or terminate this wire such that it is securely electrically connected to its associated terminal 134, with excess wire severed during the tool punching or striking. In this manner, all of the jack wires are laced and terminated at terminals 134. While the lacing path just described included a route around a lacing arm 220, it is contemplated that the path may be otherwise such that a more direct path is utilized or, for that matter, a more circuitous will enable the use of additional slack which will be available in the event of a future failure.

The joinder or assembly of clip retainer insert 130 with rear cover 128 results in a jack subassembly 62 which is ready for installation in a standard size electrical outlet box for flush mounting, or in the case of surface mounting, in universal housing 12. It must be emphasized here that housing 12, with its alternate mounting means, may be secured to a wall by means of screws 16, may be secured to a metal desk or filing cabinet by means of the mounting magnets 70, may be secured to a non-metallic or non-ferrous smooth surface by means of double-sided adhesive tape on tape pads 72, etc. This jack subassembly 62 is mounted within an electrical box by means of threaded fasteners extending through slots 208, or the subassembly may be mounted within surface-mounted universal housing 12.

Before mounting of the subassembly 62 within either an electrical box or housing 12, the installer pulls the jacketed cable alongside subassembly 62 and strips the jacket, leaving approximately 6 to 8 inches to work with. The stripped conductors and a portion of the jacket are pulled through openings 106 in housing top and/or bottom walls 32 and 34, strain relief insert 98 is placed into cavity 116 with its arcuate notch 122 facing the jacket 20. The insert 98 is urged toward and into contact with the jacket until desired holding forces are achieved and maintained. At this point, the installer commences lacing of the wires around and about lacing tabs 228 and lacing hooks 236 in the manner described. Wires are laced to their respective inner row of terminals 134 where they are first hooked and thereafter punched down with a tool.

When mounted within housing 12, after lacing, the subassembly 62 is placed such that the upper extremities of mounting posts 42 and their split fingers 48 only partially enter larger diameter and substantially circular portions 264 of slots 208 due to temporary resilient interference of protrusions 52 against the underside surfaces of bottom terminal pocket walls 196. This position is partially shown by phantom outline within FIG. 2. By the user/installer's gentle relative downward finger pressure against strap extensions 206, the mounting post fingers 48 further enter slots 208 until finger flanges 50 fully enter these slots. At this point, while maintaining this same pressure against extensions 206 and simultaneously rotating the subassembly 62 in a clockwise direction, the mounting posts 42 become releasably locked within strap extensions 206, thereby securing the subassembly in place within the universal housing 12, with side walls 198 snugly located and positioned between the movable protrusions 52 and the stationary protrusions 60. The presence of these protrusions 52 and 60 serves to inhibit or prevent undesired rotation of the subassembly 62.

Removal of this subassembly is accomplished by simply reversing the process just described — namely, by again gently pressing against strap extensions 206 and simultaneously rotating the subassembly 62 in a counter-clockwise direction until finger flanges 50 are aligned with circular slot portions 264, whereupon the subassembly may simply be lifted from the universal housing 12.

With wiring of the inner rows of terminals 134 complete, front cover plate 14 is secured to universal housing 12 as follows: the cover 14 is held at an angle with respect to the housing such that locking tabs 262 extending from top cover plate end 248 are aligned with and enter notches 266 formed in frames 212. With tabs 262 held within notches 266, the opposite raised cover plate bottom end 250 is "lowered" toward the housing 12, with alignment between the housing and cover automatically occurring due to the presence of bevel-shaped projections 124 whose sloped walls guide and bias the sides 246 thereof to an aligned position. Final closure is accomplished by gentle urging of and snapping bottom end 250 over frame 212 so that the closure is complete, with central notch 252 overlying locking tab 218.

One of the features of the present invention resides in the provision of the U-shaped rib 258 described above which, upon assembly of the cover plate 14 to universal housing 12, extends around three sides of and serves to hold the duplex jacks 132. It is this rib 258 that compensates for any possible mismatch or misalignment between front cover plate 14 and the relatively "floating" duplex-arranged jacks 132 such that no undesirable gap occurs.

It is thus seen that removal of the snap-on-off cover enables easy access to the terminals for testing and repair work with the present invention, without the use of special tools or screw terminations, and without the need to access the back of a terminal block.

The embodiments of the invention disclosed and described in the present specification and drawings and claims are presented merely as examples of the invention. Other embodiments, forms and modifications thereof will suggest themselves from a reading thereof and are contemplated as coming within the scope of the present invention.

What is claimed is:

1. A wiring device capable of installation within a standard size electrical outlet box for electrically connecting at least two conductors comprising:

a clip retainer insert comprising a pair of substantially planar members, a pair of connecting arms joining said pair of planar members, a single loop member extending outwardly from the plane of said substantially planar members, said single loop member connected at its base to one of said pair of substantially planar members and having a central opening therethrough, a double loop member extending outwardly from the plane of said substantially outward members and having first and second openings therethrough, said double loop member connected at its base to the other of said pair of substantially planar members such that said single and double loop members face each other at opposite sides of a recess defined by said pair of planar members, and by said pair of connecting arms, and said double loop member having first and second spaced apart openings therein such that first and second modular connectors can be inserted into said clip retainer between said single loop and double loop members with outwardly protruding respective portions of said first and second modular connectors being snapped into said first and second spaced apart openings, said clip retainer insert having a plurality of projecting members extending outwardly from said pair of planar members, and a rear cover, said rear cover having a plurality of apertures which correspond to said plurality of projecting members in said clip retainer insert such that said projecting members mate with said apertures in said rear cover, said rear cover being configured to fit within said standard size electrical box.

2. The wiring device of claim 1, wherein said clip retainer insert further comprises said planar members having a plurality of spaced rows of slots in which spring legs of terminals of said modular connectors can be fitted.

3. The wiring device of claim 1 wherein said single loop members and said double loop members are resilient and are mounted such that their respective upper extremities are closer to each other than their bases.

4. The wiring device of claim 1 wherein said rear cover comprises a pair of end walls each having at least one of said plurality of apertures which mate with said projecting members, a pair of spaced apart bottom walls each respectively connected to an end wall, a plurality of spaced apart ribs extending from the inner surfaces of said pair of bottom walls, a plurality of side walls attached to said bottom walls, one of said pair of bottom walls, two of said ribs, and two of said side walls forming a first terminal pocket, the other of said pair of bottom walls, another two of said ribs, and another two of said side walls forming a second terminal pocket, said first and second terminal pockets each respectively forming a seat for terminal bases of said first and second modular connectors.

5. The wiring device of claim 4 wherein said clip retainer insert further comprises each of said planar members having a shoulder at each of its ends adjacent one of said pair of connecting arms, respective pairs of said shoulders and respective ones of said pairs of connecting arms forming positioning slots whose widths closely correspond to the length of housings of said modular connectors.

6. The wiring device of claim 4 wherein said rear cover further comprises a plurality of spaced lacing members formed on said side walls.

7. The wiring device of claim 6 wherein each of said lacing members is hook-shaped and forms a gap through which conductors can be threaded or laced to provide strain relief.

8. The wiring device of claim 4 wherein said rear cover further comprises a pair of lateral walls which each are respectively joined to one of said side walls, each of said lateral walls comprising a plurality of lacing members extending therefrom.

9. The wiring device of claim 8 wherein said plurality of lacing members comprises a pair of spaced apart lacing hooks each having a vertical strut spaced far enough from one of said lateral walls such that said pair of lacing hooks provide a pathway for a predetermined number of conductors between each said vertical strut and said one of said lateral walls.

10. The wiring device of claim 1 further comprising a universal housing into which said clip retainer insert and said rear cover can be fitted, said universal housing comprising a top wall, a bottom wall, a pair of side walls extending between said top wall and said bottom wall and a rear wall whose extent is defined by said top wall, bottom walls, and side walls and which is adapted for abutting a surface for surface mounting of said universal housing thereon.

11. The wiring device of claim 10 wherein said universal housing further comprises a plurality of mounting posts each comprising a base portion integral with said rear wall, and an end portion comprising a plurality of resilient, spaced apart fingers.

12. The wiring device of claim 10 wherein said universal housing further comprises a plurality of stationary protrusions extending rearwardly from said rear wall and a plurality of resilient tabs formed by slots in said rear wall and each having a movable protrusion extending inwardly therefrom.

13. The wiring device of claim 10 wherein said universal housing further comprises a plurality of mounting compartments abutting said rear wall, said mounting compartments being substantially square shaped and comprising a plurality of shoulders and teats which cooperate to hold insertable elements in place within said mounting compartments.

14. The wiring device of claim 13 further comprising a plurality of insert tape pad supports with respective pairs of said insert tape pad supports mounted within respective said mounting compartments.

15. The wiring device of claim 13 further comprising a plurality of magnets, with respective pairs of said magnets mounted within respective said mounting compartments.

16. The wiring device of claim 10 further comprising a plurality of projections integral with said top, bottom and side walls, each said projection extending outwardly from one of said top, bottom, and side walls in a forward direction away from said rear wall, and a front cover plate which has a peripheral surface adapted to mate with said projections and thus "snap" into position in said universal housing.

17. The wiring device of claim 10 wherein said universal housing has at least one wall opening with a small breakaway tab and a large breakaway tab together sealing said wall opening with one or both tabs being broken off respectively to allow a smaller diameter or larger diameter cable to be passed through said wall opening.

18. The wiring device of claim 17 wherein said universal housing further comprises a pair of interior walls situated adjacent said wall opening, said pair of interior walls defining a strain relief cavity, a pair of strain relief tabs respectively integral with each of said pair of walls, each strain relief tab comprising a projection extending into said strain relief cavity, and a strain relief insert which fits into said strain relief cavity, said strain relief insert comprising a plurality of teeth and having an arcuate notch therein, said arcuate notch having a predetermined radius for fitting around a conductor cable of a particular size brought into said universal housing and said wall opening, said strain relief tab projection and said teeth cooperating to maintain a desired force of the insert against the cable.

* * * * *